US005626691A

United States Patent [19]

Li et al.

[11] Patent Number: 5,626,691

[45] Date of Patent: May 6, 1997

[54] BULK NANOCRYSTALLINE TITANIUM ALLOYS WITH HIGH STRENGTH

[75] Inventors: Dongjian Li; Joseph Poon; Gary J. Shiflet, all of Charlottesville, Va.

[73] Assignee: The University of Virginia Patent Foundation, Charlottesville, Va.

[21] Appl. No.: 526,096

[22] Filed: Sep. 11, 1995

[51] Int. Cl.[6] ..... C22C 14/00

[52] U.S. Cl. ..... 148/421; 420/421

[58] Field of Search ..... 148/403, 421; 420/421

[56] References Cited

U.S. PATENT DOCUMENTS

| | | | |
|---|---|---|---|
| 2,968,586 | 1/1961 | Vordahl | 148/421 |
| 4,568,398 | 2/1986 | Wood et al. | 148/421 |
| 4,909,840 | 3/1990 | Schlump | 75/232 |

*Primary Examiner*—Deborah Yee

*Attorney, Agent, or Firm*—Oblon, Spivak, McClelland, Maier & Neustadt, P.C.

[57] ABSTRACT

Bulk nanocrystalline Ti-based alloys were produced by conventional cooling from the corresponding liquid or high temperature solid phase followed by annealing at an appropriate temperature for a certain amount of time. The titanium-based alloys have a composition represented by the following formula, $Ti_aCr_bCu_cM_d$ wherein M is at least one metal element selected from the group consisting of Mn, Mo, Fe.

a, b, c, and d are atomic percentages falling within the following ranges:

$60<a<90$, $2<b<20$, $2<c<25$, and $1<d<15$.

Generally, the titanium-based alloys are in a nanocrystalline state, sometimes coexisting with an amorphous phase. These titanium-based alloys are economically produced, free of porosity and high strength (twice as that of commercial alloys) with good ductility. Furthermore, these bulk nanocrystalline alloys can be made in large-sized ingots, thermally recycled and have good processability. These properties make these alloys suitable for various applications.

13 Claims, 3 Drawing Sheets

BULK NANOCRYSTALLINE TITANIUM ALLOYS WITH HIGH STRENGTH

BACKGROUND

1. Field of the Invention

This invention relates to titanium-based nanocrystalline alloys, which are formed by conventional solidification of alloy melts, or by cooling the high temperature solid phase to room temperature to obtain a metastable body-centered cubic β crystalline phase, followed by annealing at a relatively lower temperature for an extended time to let this metastable phase transform to other more stable phases, whereas the process of nucleation and growth of nuclei are controlled by the selected annealing temperature and time so as to obtain nanocrystalline and amorphous materials.

2. Description

Increased interest on the synthesis of nanocrystalline materials in recent years dates back to the pioneering investigations of H. Gleiter in 1981. He synthesized ultra-fine metallic particles using an inert gas condensation method and consolidated them in situ into small discs under ultra-high vacuum conditions. Since then a number of techniques have been developed in which the starting material is in gaseous state (Inert gas condensation, Sputtering, Plasma processing, Vapor deposition), liquid state (Electrodeposition, Rapid solidification, Pressure-quenching), or solid state (Mechanical alloying, Sliding wear, Spark erosion, Crystallization of amorphous phase).

Most of the early results were based on materials produced by gas condensation technique, and porosity was an internal part of the materials. The properties and structures of these materials were interpreted on the basis of a two component mixture—crystalline and interfacial components—whereas they should have been interpreted by taking the porosity into account as well. In fact, reduction in Young's modulus values, increased diffusivities, and in general, variations in mechanical and physical properties have now been ascribed to the presence of porosity in these materials.

Wide-spread use and search for technological application of nanocrystalline materials require the availability of large quantities of well characterized materials with reproducible properties; and this needs to be done economically. Therefore, development of large-size bulk nanocrystalline materials without porosity is an urgent necessity.

Titanium-based alloys have been extensively used in a variety of applications, such as structural materials for aircraft, automobiles, or as body parts mainly because of their high strength-weight ratio. Now attempts are still being made to enhance tensile strength while decreasing the density.

BRIEF SUMMARY OF THE INVENTION

Therefore, it is important to look for a new technique which can prepare large bulk metal alloys directly; or simply find an appropriate alloy composition in which nanocrystalline structure can form just by cooling from the alloy melt or from the high temperature solid phase followed by annealing. The latter is more economical, and can promise industrial applications.

The composition of the alloys developed by us can be described by the following formula:

$$Ti_aCr_bCu_cM_d$$

wherein

M is at least one metal element selected from the group consisting of Mn, Mo, Fe.

a, b, c, and d are atomic percentages falling within the following ranges:

$60<a<90$, $2<b<20$, $2<c<25$, and $1<d<15$.

These titanium based alloys are of nanocrystalline structure, in some cases coexisting with an amorphous phase.

The present bulk nanocrystalline titanium-based alloy bulk ingots are useful because of their high hardness, high strength as well as their simple and inexpensive preparation. Since these titanium-based alloys exhibit superelasticity in the vicinity of β phase region, they can be successfully processed by press working, extrusion, etc. Further, even if these titanium-based nanocrystalline alloys mechanical properties degenerate, they can be recovered just by repeating the same annealing process without melting. Thus, the nanocrystalline titanium-based alloys are useful in many practical applications due to their excellent properties.

BRIEF DESCRIPTION OF THE DRAWING

The following figures provide the detailed descriptions of the manufacturing process and the phase diagrams indicate the compositional region in which nanocrystalline structure can be obtained.

DETAILED DESCRIPTION

Figure 1:
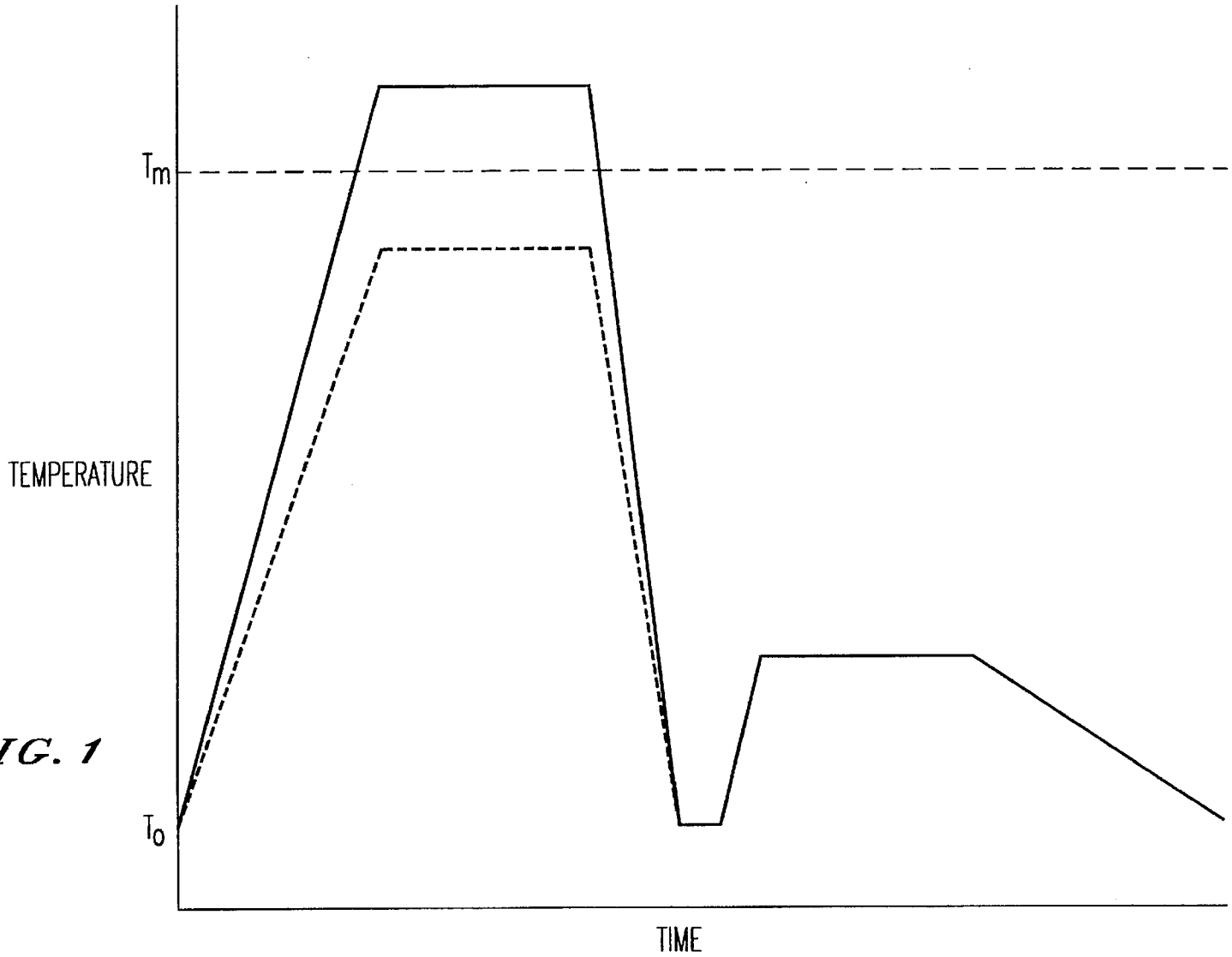
FIG. 1 illustrates schematic manufacturing process of the nanocrystalline alloy. In the figure, "Temp" denotes temperature, $T_m$ melting point, and $T_0$ room temperature.

The titanium-based nanocrystalline alloys of the present invention can be obtained by melting nominal amounts of elements in an arc furnace under an argon atmosphere followed by annealing, as shown in FIG. 1(solid line). The purity of Ti, Cr, Cu, Mn, Fe, and Mo are 99.5%, 99.5%, 99.9%, 99.5%, 99.5%, 99,5%, respectively. Generally, the shape of the ingots for scientific investigation are button-like, with the bottom diameter around 15 mm, and the height around 10 mm. Bullet-shaped ingots were also made with diameter around 15 mm and the length 80 mm. As cast samples in a evacuated quartz tube were annealed at different temperatures for different lengths of time. The parameters of temperature and time were selected according to DTA(Differential Thermal Analyzer) results.

The titanium-based nanocrystalline alloy can also be obtained by air cooling of the ingots from 1000° C. followed by annealing (see the dash line in FIG. 1), because the high temperature crystalline phase β, can be easily retained at room temperature as a metastable phase. Thus, it is undoubtly that a large-size bulk titanium-based nanocrystalline alloy can be produced with appropriate compositions.

The nanocrystalline structure can be identified by X-ray and TEM. Crystalline peaks of 2 degrees wide (Cu Kα radiation) can be seen in X-ray diffraction pattern, and nanocrystalline grains can be directly determined by TEM. Sometimes halo background was shown in the X-ray pattern as well as diffuse ring in the TEM diffraction pattern, indicating the existence of an amorphous structure.

The basic principle for the formation of nanocrystalline structure is that the metastable crystalline phase, β, either obtained from the alloy melt or from a high temperature solid phase, has higher free energy than that of the stable crystalline phase α. Therefore, if the as-cast sample is annealed, the β phase will eventually transform into more stable crystalline phases during annealing. From DTA results, the phase transformation from β to α occurs around 750° C., so, the as-cast alloys were annealed at a lower temperature, for example, 450° C. for 20hrs. Transformation to an intermediate phase was detected by x-ray diffraction patterns and TEM images. The annealing temperature is apparently too low for the new crystalline nuclei to grow, indicating that it is possible to obtain a micro-crystalline structure. If an appropriate temperature and time are selected, nanocrystalline structure will be obtained.

Figure 2:
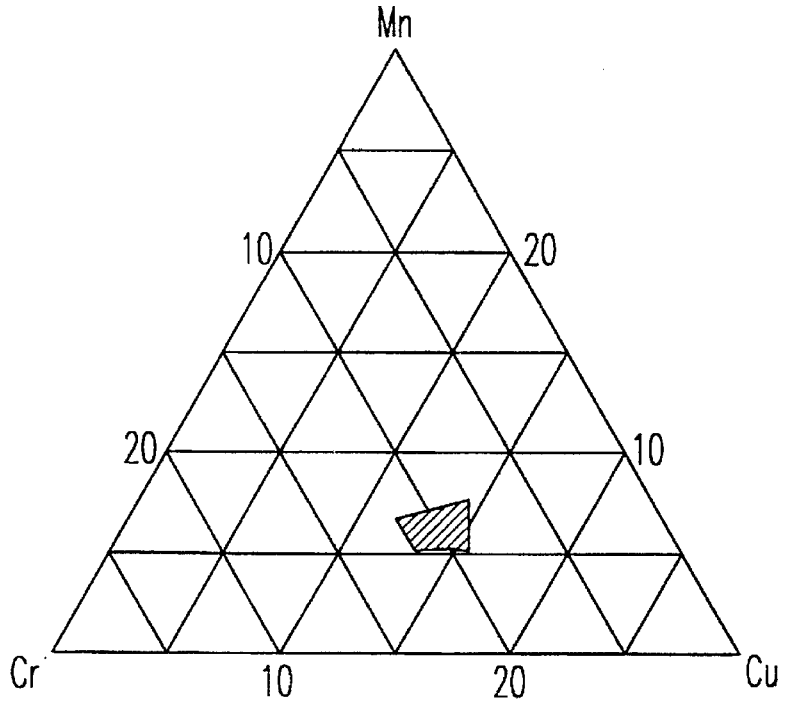
FIG. 2 is a quasi-ternary composition diagram comprising chromium, copper and manganese at the condition of the content of titanium about 70 per cent (atomic) indicating a nanocrystal-forming region of alloys provided in practice of this invention.
Figure 3:
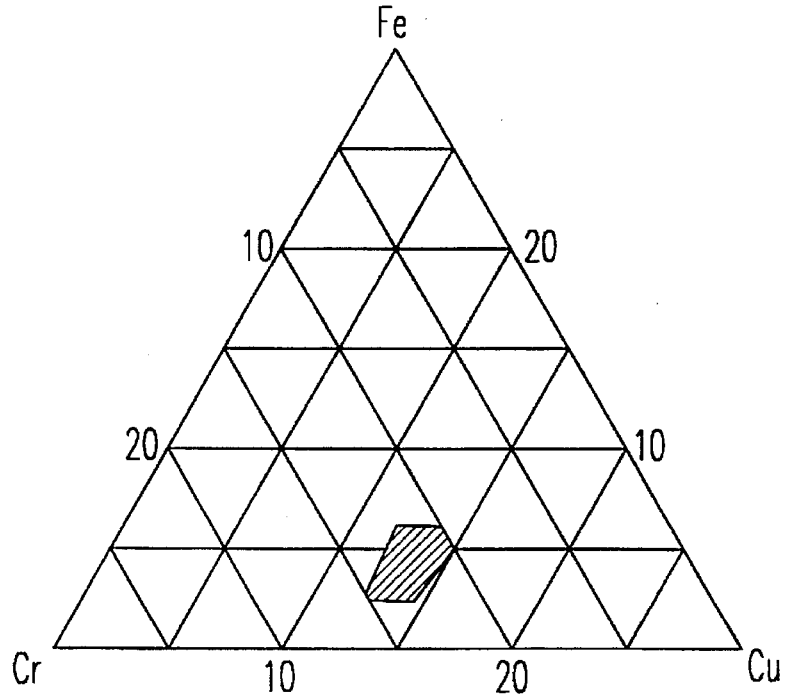
FIG. 3 is a quasi-ternary composition diagram comprising chromium, copper and iron at the condition of the content of titanium about 70 per cent (atomic) indicating a nanocrystal-forming region of alloys provided in practice of this invention.
Figure 4:
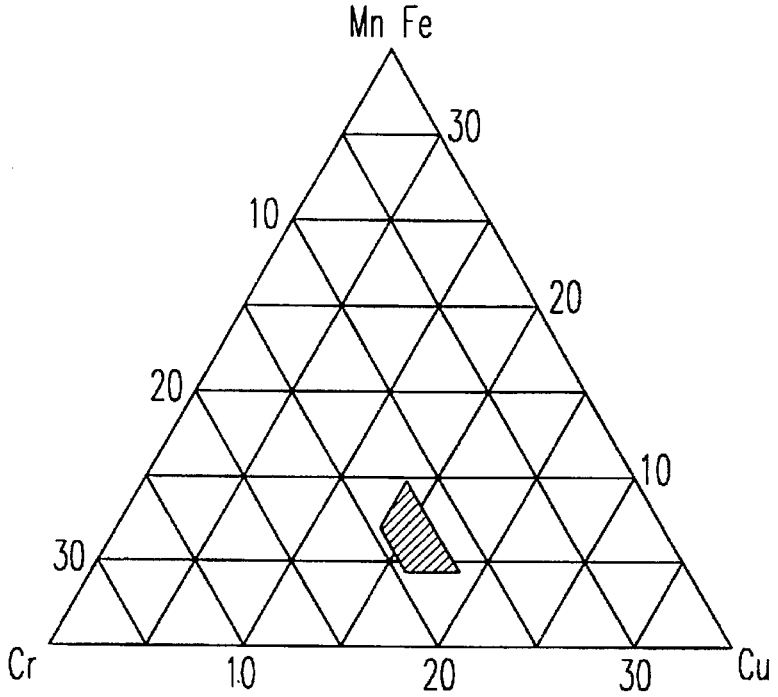
FIG. 4 is a quasi-ternary composition diagram comprising chromium, copper, manganese and iron at the condition of the content of titanium about 65 per cent (atomic) indicating a nanocrystal-forming region of alloys provided in practice of this invention.
Figure 5:
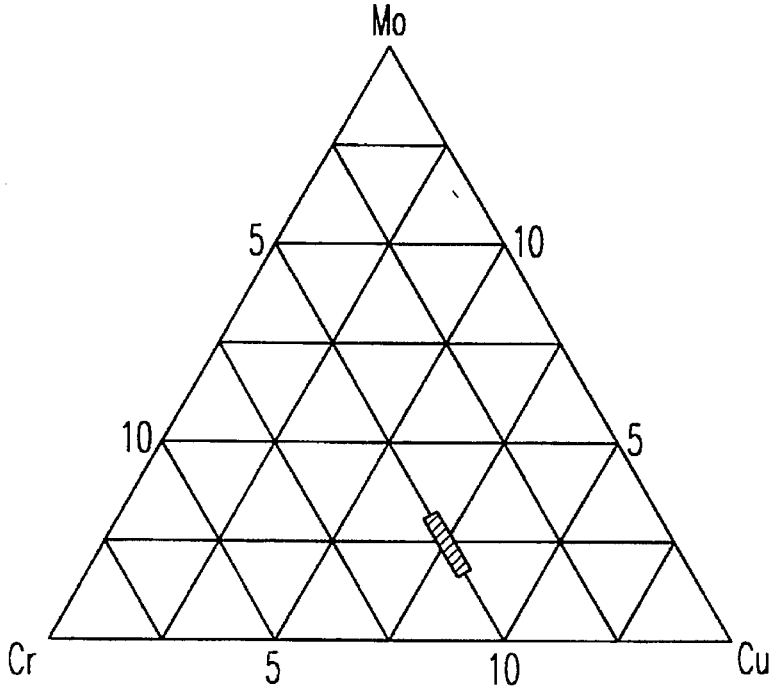
FIG. 5 is a quasi-ternary composition diagram comprising chromium, copper, molybdenum at the condition of the content of titanium about 85 per cent (atomic) indicating a nanocrystal-forming region of alloys provided in practice of this invention.

For titanium-based alloy, Cr, Cu, Mn, Fe and Mo, are all β stabilizing elements. Combination of titanium and at least two of above elements can retain the β phase at room temperature, even at very slow cooling rates, which makes the formation of large-size bulk nanocrystalline alloy possible. As illustrated in FIG. 2, the nanocrystal-forming region is where Mn is between 6 and 9 percent, Cu between 12 and 16, and Cr between 7 and 13 while Ti is 70 percent. For the system of Ti(70%)-Cr-Cu-Fe (see FIG. 3), the nanocrystal-forming region is between 12 to 16 percent for copper, 2 to 7 percent for iron, and 10 to 15 percent for chromium. If five components(Ti=65%, Cr, Cu, Mn and Fe) are melted together, as shown in FIG. 4, the nanocrytsal-forming area moves to 13<Cu<18, 4<Mn+Fe<10, and 12<Cr<15. Provided that Manganese or Iron are replaced by Molybdenum (see FIG. 5), the content of titanium can be enhanced to 85%, and the nanocrystal-forming area becomes very narrow. (7<Cu<8, 2<Mo<3, and Cr around 5).

When these sorts of titanium-based nanocrystalline alloy are reheated to high temperatures, over 1000° C., they transform back to the β phase again. Repeating the same low-temperature annealing as mention above, bulk nanocrystalline materials can be recovered. Thus, these titanium-based nanocrystalline materials can be used repeatedly.

In addition, titanium-based alloy an high temperatures (β phase area) exhibits excellent processability, and they can be successfully processed by extrusion, press working, and forging, etc. This is very useful for the application of nanocrystalline materials because the alloys can be processed at high temperature first, then treated to obtain much stronger nanocrystalline structure.

EXAMPLES

According to the processing conditions as illustrated in FIG. 1, there were dozens of samples of titanium alloy listed in the following table having nanocrystalline structure or composite of nanocrystalline and amorphous structure as well as nanocrystalline and microcrystalline structure identified by use of X-ray and TEM analyses. Phase transformation temperatures and hardness($H_v$) were measured for selected samples, and the results are shown in the right columns of the table. The hardness is indicated by values (MPa) measured using a micro Vickers Hardness tester under the load of 10 kg. All the hardness data are for the annealed specimens. The temperature $T_1$ is the peak temperature of the first exothermic peak on the DTA(Differential Thermal Analyzer) curve which was obtained at a heating rate of 20K/min; and $T_2$ is the onset temperature of an endothermic peak, and marks either a peritectic reaction or onset of melting. In the table the following symbols represent: "Stru": structure; "NC": nanocrystalline; "NC+MC": composite structure of nanocrystalline and microcrystalline structure. "NC+A": composite structure of nanocrystalline and amorphous structure.

TABLE

| | | Stru | $H_v$ (MPa) | $T_1$ (°C.) | $T_2$ (°C.) |
|---|---|---|---|---|---|
| 1 | $Ti_{70}Cr_8Cu_{14}Mn_8$ | NC + A | 1475 | 731 | 1490 |
| 2 | $Ti_{70}Cr_{11}Cu_{12}Mn_7$ | NC | 1585 | 725 | 1510 |
| 3 | $Ti_{70}Cr_9Cu_{13.5}Mn_{7.5}$ | NC | | | |
| 4 | $Ti_{70}Cr_{12.5}Cu_{13.5}Fe_4$ | NC | 1625 | 771 | 1446 |
| 5 | $Ti_{70}Cr_{12.5}Cu_{12.5}Fe_5$ | NC | | | |
| 6 | $Ti_{70}Cr_{13}Cu_{13.5}Fe3_{.5}$ | NC | | | |
| 7 | $Ti_{65}Cr_{13}Cu_{16}Mn_4Fe_2$ | NC + A | 1675 | 730 | 1530 |
| 8 | $Ti_{65}Cr_{14}Cu_{14}Mn_4Fe_3$ | NC | | | |
| 9 | $Ti_{65}Cr_{14.5}Cu_{14.5}Mn_4Fe_2$ | NC | | | |
| 10 | $Ti_{65}Cr_{12}Cu_{16}Mn_5Fe_2$ | NC | | | |
| 11 | $Ti_{65}Cr_{13}Cu_{15}Mn_5Fe_2$ | NC | | | |
| 12 | $Ti_{65}Cr_{13}Cu_{15}Mn_4Fe_3$ | NC | | | |
| 13 | $Ti_{65}Cr_{13}Cu_{16}Mn_3Fe_3$ | NC | | | |
| 14 | $Ti_{70}Cr_{11}Cu_{13}Mn_4Fe_2$ | NC | | | |
| 15 | $Ti_{65}Cr_{14}Cu_{16}Mn_2Fe_3$ | NC | | | |
| 16 | $Ti_{85}Cr_5Cu_8Mo_2$ | NC | 2095 | | |
| 17 | $Ti_{85}Cr_5Cu_7Mo_3$ | NC + A | | | |
| 18 | $Ti_{70}Cr_{7.5}Cu_{13.5}Mn_9$ | NC + MC | | | |
| 19 | $Ti_{70}Cr_6Cu_{12}Mn_{12}$ | NC + MC | 1472 | | |
| 20 | $Ti_{70}Cr_{12}Cu_{10}Mn_8$ | NC + MC | | | |
| 21 | $Ti_{70}Cr_{10}Cu_{10}Mn_{10}$ | NC + MC | 1753 | | |
| 22 | $Ti_{70}Cr_{12}Cu_{12}Mn_6$ | NC + MC | | | |
| 23 | $Ti_{65}Cr_{20}Cu_{15}$ | NC + MC | | | |
| 24 | $Ti_{70}Cr_{10}Cu_{15}Fe_5$ | NC + MC | | | |
| 25 | $Ti_{75}Cr_{7.5}Cu_{11}Fe_{6.5}$ | NC + MC | 1510 | | |
| 26 | $Ti_{70}Cr_{11.5}Cu_{13.5}Fe_5$ | NC + MC | | | |
| 27 | $Ti_{70}Cr_{10}Cu_{14}Fe_6$ | NC + MC | | | |
| 28 | $Ti_{70}Cr_{11.5}Cu_{12.5}Fe_6$ | NC + MC | 1680 | | |
| 29 | $Ti_{70}Cr_{11.5}Cu_{15}Fe_{4.5}$ | NC + MC | | | |
| 30 | $Ti_{70}Cr_{13.5}Cu_{14}Fe_{2.5}$ | NC + MC | | | |
| 31 | $Ti_{65}Cr_{15}Cu_{18}Fe_2$ | NC + MC | | | |
| 32 | $Ti_{65}Cr_{15}Cu_{16}Mn_2Fe_2$ | NC + MC | | | |
| 33 | $Ti_{65}Cr_{12}Cu_{17}Mn_4Fe_2$ | NC + MC | | | |
| 34 | $Ti_{65}Cr_{14}Cu_{15}Mn_3Fe_3$ | NC + MC | 1458 | | |
| 35 | $Ti_{65}Cr_{13}Cu_{14}Mn_5Fe_3$ | NC + MC | 1850 | | |
| 36 | $Ti_{70}Cr_{12}Cu_{12}Mn_4Fe_2$ | NC + MC | | | |
| 37 | $Ti_{65}Cr_{13}Cu_{13}Mn_6Fe_3$ | NC + MC | | | |
| 38 | $Ti_{65}Cr_{13}Cu_{14}Mn_5Fe_3$ | NC + MC | | | |
| 39 | $Ti_{65}Cr_{14}Cu_{13}Mn_5Fe_3$ | NC + MC | | | |
| 40 | $Ti_{65}Cr_{15}Cu_{14}Mn_3Fe_3$ | NC + MC | | | |
| 41 | $Ti_{65}Cr_{13}Cu_{17}Mn_2Fe_3$ | NC + MC | | | |
| 42 | $Ti_{85}Cr_5Cu_{8.5}Mo_{1.5}$ | NC + MC | 1596 | | |

Titanium-based alloys of the present invention have an extremely high hardness of the order of about 1200 to 2500 MPa, two times as hard as that of the commercial titanium-based alloys (600–1100 MPa). Average values obtained from measurements made on given samples are listed in the Table.

The alloy No. 16 given in Table was measured for the tensile strength.

The densities were measured for as-cast alloy Nos. 1, 4, and 16, which is 5,439 g/cm$^3$ for the alloy No. 1, 5.516 g/cm$^3$ for the alloy No. 4, and 5.035 g/cm$^3$ for the alloy No. 16. The densities of these three alloys are decreased by 1–2 percentage after annealing.

What is claimed is:

1. A high strength nanocrystalline titanium-based alloy having a composition represented by the formula:

$Ti_aCr_bCu_cM_d$ wherein M is at least one metal element selected from the group consisting of Mo, Mn and Fe, and wherein a, b, c, and d are atomic percentages falling within the following percentages:

$60<a<90$, $2<b<20$, $2<c<25$, and $0<d<15$, obtained by annealing the metastable crystalline phase β produced from either (1) a melt or (2) a high temperature solid phase, of the above metal elements in the above atomic percentages, to produce a nanocrystalline structure in at least a part of said alloy, the remaining part of said alloy having an amorphous or microcrystalline structure.

2. The alloy of claim 1 wherein M is Mn.

3. The alloy of claim 1 wherein M is Mo.

4. The alloy of claim 1 wherein M is Fe.

5. The alloy of claim 1 wherein M is Fe and Mn.

6. The alloy of claim 1, wherein the metastable crystalline phase β is produced from a melt.

7. The alloy of claim 1 wherein the metastable crystalline phase β is produced from a high temperature solid phase.

8. The alloy of claim 2, wherein a is about 70, b is between about 7 and 13, c is between about 12 and 16, and d is between about 6 and 9.

9. The alloy of claim 3, wherein a is about 85, b is about 5, c is between about 7 and 8, and d is between about 2 and 3.

10. The alloy of claim 4, wherein a is about 70, b is between about 10 and 15, c is between about 12 and 16, and d is between about 2 and 7.

11. The alloy of claim 5, wherein a is about 70, b is between about 12 and 15, c is between about 13 and 18, and d is between about 4 and 10.

12. A high strength nanocrystalline titanium-based alloy having a composition represented by the formula:

$Ti_aCr_bCu_cM_d$ wherein M is at least one metal element selected from the group consisting of Mn, Mo and Fe, and wherein a, b, c, and d are atomic percentages falling within the following percentages:

$60<a<90$, $2<b<20$, $2<c<25$, and $0<d<15$, obtained by (1) annealing the metastable crystalline phase β produced from a high temperature solid phase, of the above metal elements in the above atomic percentages, to produce a nanocrystalline structure in at least a part of said alloy, the remaining part of said alloy having an amorphous or microcrystalline structure, (2) reheating said alloy to form the metastable crystalline phase β, (3) repeating step (1), and optionally, (4) repeating steps (2) and (1) one or more times.

13. The alloy of claim 1, selected from alloys numbered 1–42 of the TABLE at pages 8–9 of the specification.

* * * * *